United States Patent [19]

Kopelman

[11] 4,217,089

[45] Aug. 12, 1980

[54] PHOTOFLASH LAMP

[75] Inventor: Bernard Kopelman, Magnolia, Mass.

[73] Assignee: GTE Products Corporation, Stamford, Conn.

[21] Appl. No.: 546,242

[22] Filed: Feb. 3, 1975

[51] Int. Cl.[2] ..... F21K 5/02

[52] U.S. Cl. ..... 431/362; 264/165; 264/332; 164/87

[58] Field of Search ..... 431/93–95, 431/361, 362

[56] References Cited

U.S. PATENT DOCUMENTS

| | | | |
|---|---|---|---|
| 2,351,290 | 6/1944 | Rippl et al. | 431/95 |
| 3,822,109 | 7/1974 | Shaffer | 431/93 |
| 3,838,185 | 9/1974 | Maringer et al. | 264/8 |
| 3,889,347 | 6/1975 | Villani | 431/93 |
| 3,895,902 | 7/1975 | Broadt et al. | 431/93 |
| 3,896,203 | 7/1975 | Maringer et al. | 264/8 |

*Primary Examiner*—Carroll B. Dority, Jr.
*Attorney, Agent, or Firm*—Edward J. Coleman

[57] ABSTRACT

A photoflash lamp in which the combustible material within the lamp envelope comprises a plurality of filaments released from the periphery of a rotating heat-extracting disk in contact with a melt of suitable combustible material, such as hafnium, zirconium or magnesium. Filament configurations are determined to a large degree by the peripheral geometry of the rotating disk. In one embodiment, the filaments have unequal lengths, while in another arrangement, filaments having unequal cross-sections are arranged in a substantially homogeneous mass. In yet another embodiment, each of the filaments has periodic notches along the length thereof.

6 Claims, 9 Drawing Figures

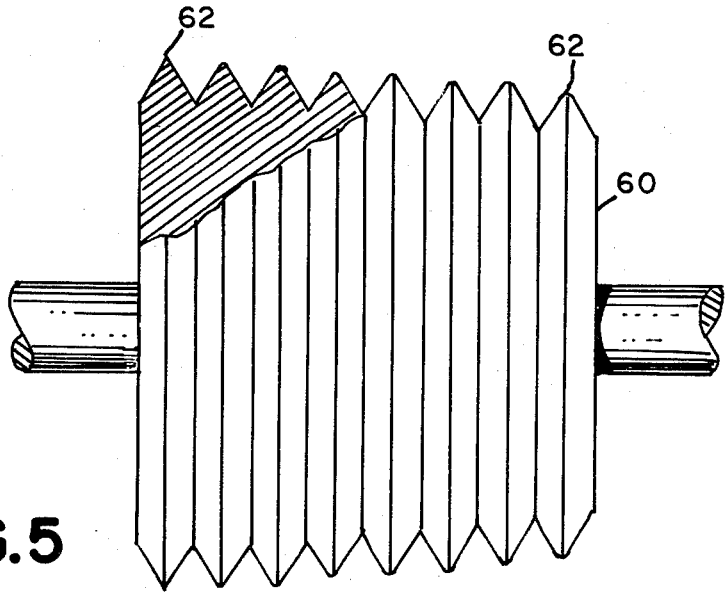
FIG.5
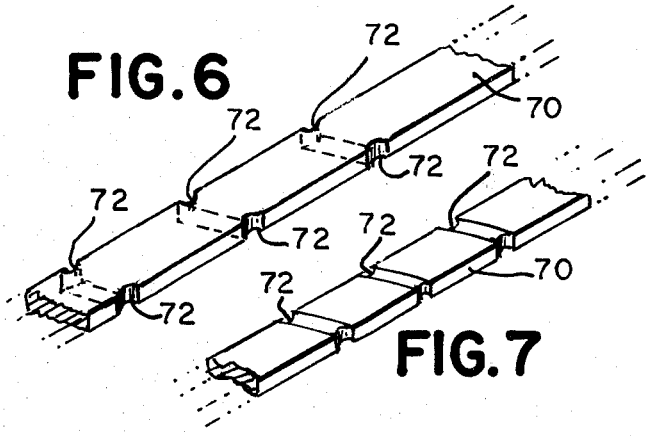
FIG.6
FIG.7
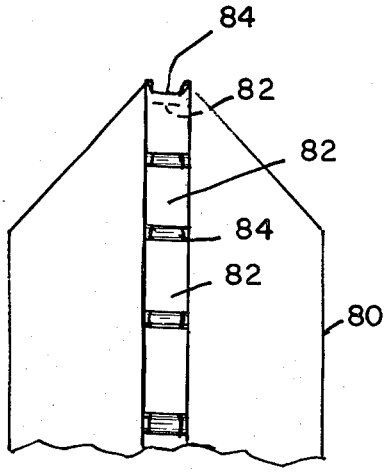
FIG.8
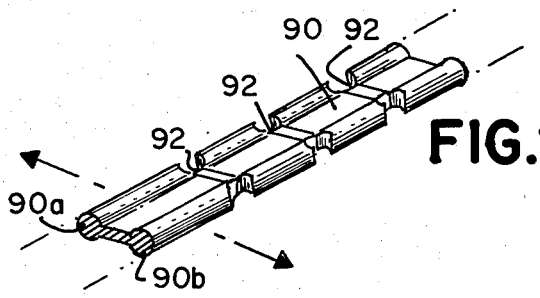
FIG.9

PHOTOFLASH LAMP

BACKGROUND OF THE INVENTION

This invention relates to photoflash lamps and particularly to photoflash lamps containing a filamentary combustible material which is ignited to produce actinic light.

A typical photoflash lamp comprises an hermetically sealed glass envelope containing a quantity of filamentary combustible material, such as fine strands of zirconium or hafnium, and a combustion-supporting gas, such as oxygen, at a pressure well above one atmosphere. In lamps intended for battery operated flash systems, the envelope also includes an electrical ignition system comprising a tungsten filament supported on a pair of lead-in wires having a quantity of ignition paste on the inner ends thereof adjacent to the filament. This type of lamp is operated by the passage of an electrical current through the lead-in wires which incandesces the filament to ignite the ignition paste which in turn ignites the combustible metal in the envelope. In the case of percussive-type photoflash lamps, such as described in U.S. Pat. No. 3,535,063, a mechanical primer is sealed in one end of the lamp envelope. The primer may comprise a metal tube extending from the lamp envelope and a charge of fulminating material on an anvil wire supported in the tube. Operation of the percussive photoflash lamp is initiated by an impact onto the tube to cause deflagration of the fulminating material up through the tube to ignite the combustible metal disposed in the lamp envelope.

The combustible fill material comprises a major constituent of a photoflash lamp, and consequently the cost of the fill material has a significant impact on the cost of the finished lamp. In the early history of photoflash, the combustible material employed in the lamps generally comprised an extremely thin metallic foil and/or a fine metallic wire, both of which proved relatively expensive. In the case of the foil, which was typically aluminum having a thickness in the order of 0.000015 to 0.000020 inch, in order to obtain such extremely thin foil, the aluminum was rolled into thin sheets and then beaten between heating forms, in the manner known for the preparation of gold foils, until the desired thinness was obtained. Such a slow and costly process made the aluminum foil quite expensive. Likewise, the wire used in flash lamps (typically aluminum or aluminum-magnesium alloy) underwent an involved and expensive wire-drawing process in order to be drawn down to the required size, typically 1.5 mils or less in diameter, for flashlamp use.

Accordingly, with the object of reducing the cost of flashlamps, further development work in this field resulted in the production and use of shredded foil as a substantially less expensive filamentary combustible material for use in flashlamps. Typically, the shredded foil is formed by feeding a thin sheet of the combustible metal material into a suitable cutting machine, such as the reel type shredder shown in U.S. Pat. No. 2,699,831 for example. The thin strands of foil produced by the cutting machine are then introduced and distributed into the lamp envelopes with the aid of a moving current of air, such as described, for example, in U.S. Pat. Nos. 2,772,703 and 2,862,529. Aluminum foil has been used for this purpose, although more recently, zirconium and hafnium have been found to provide significant photometric advantages. Typically, zirconium or hafnium foil having a thickness of about 0.95 mil is shredded to provide four inch long strands having a width of about 1.2 inch. Thus, the cross-section of each strand is rectangular but distorted somewhat along one or two edges by the shearing action of the cut.

Although providing subminiature flashlamps with high light output characteristics, shredded zirconium foil and, more particularly, hafnium foil, are quite expensive and constitute an appreciable portion of the cost of the lamp. While zirconium and hafnium metals in themselves are relatively expensive, a greater part of the cost arises from the large amount of work in reducing the materials to a foil less than one mil thick. For example, the price of zirconium foil may be about twice the basic price of the zirconium metal, and the cost of hafnium foil may exceed four times the basic metal price.

In addition to these cost considerations, a variety of strand configurations have been employed to improve the distribution and ignition characteristics of the shredded combustible foil in smaller size lamps. For example, in order to improve useful light output by minimizing molten droplet size and the light-quenching wall contact effect of the long four inch strands in subminiature lamps, a copending U.S. Patent Application Ser. No. 179,056, filed Sept. 9, 1971, now U.S. Pat. No. 3,895,902, and assigned to the present assignee, describes the use of short shreds (e.g., strand lengths of 0.200 inch) arranged in a manner to keep the bulk of the combustible material away from the wall of the lamp envelope. Accordingly, the use of the shorter strand lengths significantly increases the efficiency of combustion in lamps of less than one cubic centimeter internal volume by substantially reducing the lateral contact areas between the combustible material and lamp wall. In addition the smaller shreds produce smaller molten droplets during the combustion process. A manufacturing drawback to the use of short shreds, however, is that the production of such shreds by the use of slot foil on the shredding machine can prove to be a difficult mechanical set up for obtaining uniform results. On the other hand, in the case of flashlamps having an internal envelope volume substantially larger than 1 cc., the short shred configuration would appear to be somewhat impractical since support of the desired shred distribution by the envelope wall would be virtually impossible with standard loadings.

Another strand configuration directed toward optimizing combustion in subminiature lamps by supporting the shredded foil away from the envelope wall is described in U.S. Pat. No. 3,630,650. According to this arrangement, shreds of 100 mm. (about 4 inches) in length are crumpled to have a random configuration of from 8 to 50 sharp bends per strand to effect point contact between the filling and the envelope wall. When distributed in the lamp, each 100 mm. shred forms a ball with a cross-sectional area of from 40 to 8 $mm^2$. This crumpled foil packing geometry provides significantly improved light output over that obtainable using the old intermingled loop configuration, however, it does not permit the degree and uniformity of droplet size control attained by strand configurations such as that described in U.S. Pat. No. 3,792,957 of Bouchard et al.

The above-mentioned Bouchard et al patent describes a flashlamp having a filamentary combustible in which each of the strands comprises substantially uniform periodic variations adapted when burning to eject a predetermined number of molten droplets per unit length of strand. According to one embodiment, each strand has a coiled configuration with a diameter of from 0.010 to 0.030 inch and a pitch of from 20 to 300 turns per inch. In an alternative embodiment, each strand is crimped to provide a plurality of substantially straight segments of approximately equal length interconnected at sharp bends in the strand. The length of each segment may be from 0.010 to 0.060 inch and the bend angle may be from 60° to 165°. When ignited and burning in a flashlamp, such crimped or coiled strands produce a greater number of molten droplets without altering the quantity of combustible material, fulminating material, or gas fill. In particular, the uniformity of the periodic variations in the strand configuration causes droplets of substantially uniform size to be ejected by centrifugal force when the strand is burning and the dimensional constraints on the configuration provide for a significant reduction in size (and thus increase in number) of the ejected droplets. Operation of flashlamps employing such combustible foil configurations has been observed to provide significantly improved light output characteristics. This approach, however, also has the disadvantage of being relatively difficult and costly to implement on high-speed production machinery.

SUMMARY OF THE INVENTION

In view of the foregoing, a principal object of this invention is to provide a photoflash lamp containing a filamentary combustible material in a form that is substantially less expensive than heretofore available while providing at least substantially the same performance.

A particular object of the invention is to provide a flashlamp having a filling of relatively inexpensive combustible material comprising a plurality of filaments having one or more of a selection of configurations for improving or controlling light output characteristics and including filament configurations and distributions heretofore impractical or unfeasible to employ.

These and other objects, advantages and features are attained in accordance with the invention by providing a flashlamp containing a quantity of combustible material comprising a plurality of filaments released from the periphery of a rotating heat-extracting disk in contact with a melt of the combustible material. Filament configurations are determined to a significant degree by the peripheral geometry of the rotating disk. Preferred combustible materials include zirconium, hafnium and magnesium. The filaments may have unequal lengths and/or unequal cross-sections arranged in a substantially homogeneous mass. Short shred filaments (less than 1.2 times the envelope ID) may be readily produced by providing spaced notches in the periphery of the rotating disk. Possible configurations include filaments having periodic notches along their length to produce a greater number of smaller droplets when burning.

BRIEF DESCRIPTION OF THE DRAWINGS

This invention will be more fully described hereinafter in conjunction with the accompanying drawings, in which:

FIG. 5 shows a partial cross-section of a multiple edge heat extracting disk;

FIG. 6 is a greatly enlarged top perspective view of a notched filament in accordance with the invention;

FIG. 7 is a greatly enlarged bottom perspective view of a notched filament in accordance with the invention;

FIG. 8 is a fragmentary view of a heat-extracting disk having periodic ridges in a circumferential groove for producing the notched filament of FIGS. 6 and 7; and FIG. 9 is a greatly enlarged bottom perspective view of a notched filament having a dumb bell shaped cross-section in accordance with the invention.

DESCRIPTION OF PREFERRED EMBODIMENT

The teachings of the present invention are applicable to either percussive or electrically ignited photoflash lamps of a wide variety of sizes and shapes. Accordingly, FIGS. 1 and 2 respectively illustrate electrically ignited and percussive-type photoflash lamps embodying the principles of the invention.

Figure 1:
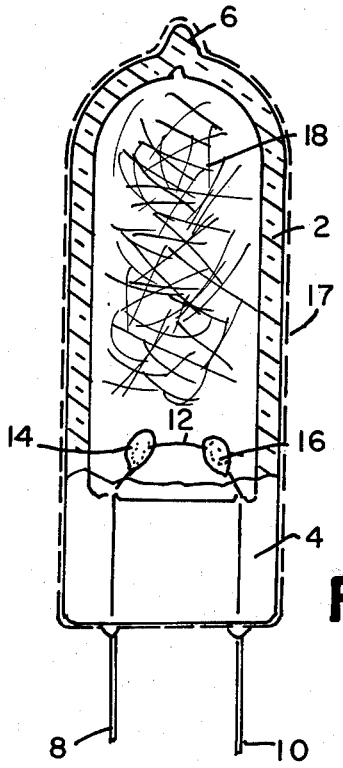
FIG. 1 is an enlarged elevational view, partly in section, of an electrically ignitable photoflash containing a filamentary combustible material in accordance with the invention.

Referring to FIG. 1, the electrically ignitable lamp comprises an hermetically sealed, light-transmitting lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner end of the lead-in wires, and beads of primer 14 and 16 are located on the inner ends of the lead-in wires 8 and 10 respectively at their junctions with the filament. Typically, the lamp envelope 2 has an internal diameter of less than one-half inch, and an internal volume of less than 1 cc., although the present invention is equally suitable for application to larger lamp sizes. The exterior surface of the glass envelope is covered with a protective coating 17 (denoted by dashed lines) such as cellulose acetate lacquer or a vacuum-formed thermoplastic coating, such as described in U.S. Pat. No. 3,770,366. A combustion-supporting gas, such as oxygen, and a quantity of filamentary combustible material 18, of a type in accordance with the invention, are disposed within the lamp envelope. Typically, the combustion-supporting gas fill is at a pressure exceeding about 500 centimeters of mercury, and the lamp is loaded with at least about 18 milligrams of the filamentary combustible material. As will be described in more detail hereinafter, the combustible fill 18 comprises a plurality of filaments of a material such as zirconium, hafnium or magnesium which have been formed by release from the periphery of a rotating heat-extracting disk in contact with a melt of the material.

Figure 2:
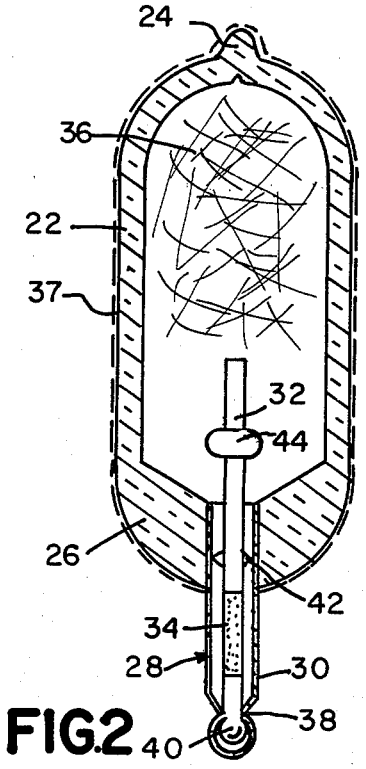
FIG. 2 is an enlarged sectional elevation of a percussive-type photoflash lamp containing a filamentary combustible in accordance with the invention.

The percussive-photoflash lamp illustrated in FIG. 2 comprises a length of light-transmitting tubing defining an hermetically sealed lamp envelope 22 constricted at one end to define an exhaust tip 24 and shaped to define a match seal 26 about a primer 28 at the other end thereof. The primer 28 comprises a metal tube 30, a wire anvil 32, and a charge of fulminating material 34. A quantity of combustible metal 36, such as zirconium or hafnium or magnesium filaments of a type in accordance with the invention, and a combustion-supporting gas, such as oxygen, are disposed within the lamp envelope, with the fill gas typically being at a pressure of greater than about 500 cm. Hg and the quantity of combustible metal fill being at least about 18 mgs. The exterior surface of the glass envelope is covered with a protective coating 37, such as cellulose acetate lacquer or a vacuum-formed thermoplastic.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A refractory or metal bead 44 is located on the wire anvil 32 just above the inner mouth of the primer tube 30 to eliminate tube 30 burn-through and function as a deflector to deflect and control the ejection of hot gases from the fulminating material in the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible material 18 or 36. More specifically, the igniter filament 12 of the flash lamp in FIG. 1 is incandesced electrically by current passing through the metal filament support leads 8 and 10, whereupon the incandescent filament 12 ignites the beads of primer 14 and 16 which in turn ignite the combustible material 18 disposed within the lamp envelope. Operation of the percussive-type lamp of FIG. 2 is initiated by an impact onto tube 30 to cause deflagration of the fulminating material 34 up through the tube 30 to ignite the combustible material 36 disposed within the lamp envelope. The invention is also applicable to other types of electrically ignited lamps with a filamentary combustible, such as those lamps having spark gap or primer bridge ignition structures for use with high voltage pulse power supplies employing a capacitor discharge arrangement or a piezoelectric element.

In attaining the objects of the invention, I have discovered that a comparatively inexpensive filamentary combustible material with relatively flexible configuration capabilities can be provided by employing a melt extraction process, such as described in U.S. Pat. No. 3,838,185 and copending application Ser. No. 353,692, filed Apr. 23, 1973, and now issued as U.S. Pat. No. 3,896,203 to produce the filaments of combustible material for filling flashlamps. Broadly speaking, the melt extraction process is a method for producing continuous or controlled length discontinuous products having a small cross sectional area, such as filaments or wire, directly from a source of molten metal; more specifically, such products are formed by the application of a rotating heat-extracting disk-shaped member to the surface of the molten metal so as to form the material into a desired shape by extracting a filamentary form of material from the supply of molten metal. The shape of the final product is controllable and is primarily affected by the physical shape of the rotating disk applied to the melt, its heat extracting properties, the temperatures and material composition of the melt, and the velocity of the member in contact with the melt. There are alternative approaches for providing the source of molten metal in contact with the rotating disk. For example, in the above-referenced U.S. Pat. No. 3,838,185, the melt comprises a pool, or bath, of molten metal into which the peripheral-edge of the rotating disk is introduced, an arrangement which has been referred to as a "crucible extraction process". On the other hand, Patent Application Ser. No. 353,692, now U.S. Pat. No. 3,896,203, describes an arrangement referred to as "pendant drop extraction", wherein the melt comprises an unconfined drop of molten metal produced by the local heating of an elongated solid member advanced toward the edge of the rotating disk.

Figure 3:
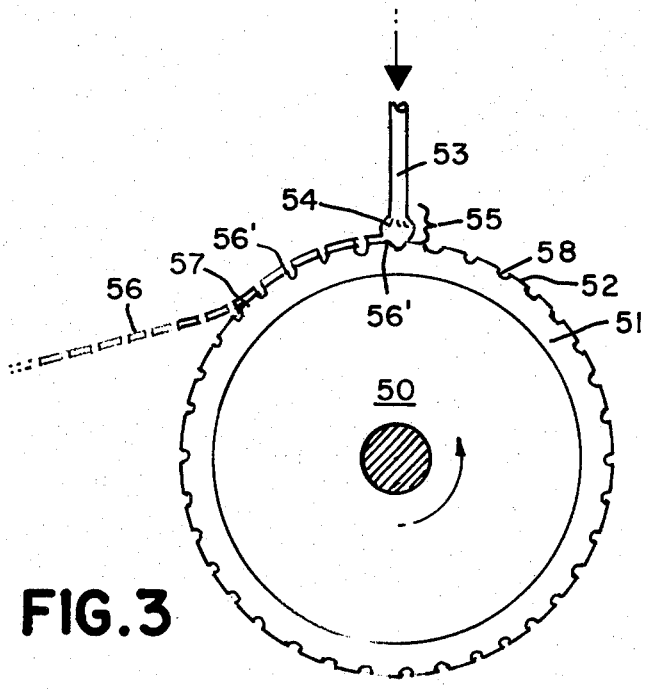
FIG. 3 is an elevational view of a rotating heat-extracting disk having notches for forming a plurality of short filaments from a drop of molten combustible material pendant on a rod-like source of material.
Figure 4:
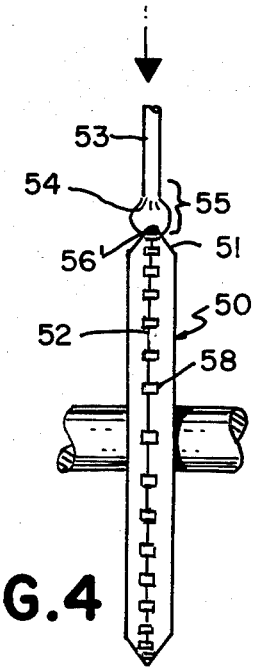
FIG. 4 is a side view of FIG. 3.

FIGS. 3 and 4 illustrate the referenced pendant drop extraction method as applied to providing filaments of combustible material for loading flashlamps. The rotating heat extracting disk 50 has a V-shaped periphery, or edge, 52 on a circumferential projection 51. Disk 50 is rotated in the direction indicated by the arrow in FIG. 3 so as to contact a molten portion of the rod 53, which in this instance comprises a combustible metal such as zirconium, hafnium or magnesium. Rod 53 is the material supply for the process, with the portion 54 of the metal rod 53 being melted by some means of local heating at 55. The local heating of portion 55 creates a molten zone adherent to the rod 53 but in contact with the moving edge 52. The surface tension of the material in the melt portion 54 is sufficient to maintain stability even with the edge 52 entering and incuding a shear flow within the liquid portion 54. For purposes of definition, the unconfined material adherent to the solid rod is termed a pendant drop irrespective of the geometric configuration of the drop to the solid member or the force of gravity. The drop is unconfined in that it is not restrained by any member disposed to oppose the shear forces generated by the forming member passing through the drop. When the peripheral edge 52 passes through the pendant drop 54, a portion 56' of the molten material solidifies on the edge 52. Further rotation of the disk 50 draws this solidified filamentary portion 56' out of the pendant drop 54. If there were no notches 58 in the periphery 52, the rotating disk 50 would then carry the filament 56', still adherent to edge 52, until it separates (is released) from the periphery 52 at point 57 to become a collectable solid continuous filament. In this instance (FIGS. 3 and 4), however, the rotating heat-extracting disk has semi-circular notches 58 on edge 52 which attenuate the combustible material into discrete filaments 56 equal in length to the distance between the notches.

If a crucible extraction process is employed, the notches in the edge of the heat-extracting disk may take the form of a slanted V as described in U.S. Pat. No. 3,838,185.

The ultimate size of the combustible filaments 56 is determined by the amount of molten material available at the periphery of disk 50, the shape of the edge introduced into the pendant drop, the viscosity of the molten material, and the speed at which the edge is passed through the pendant drop. For use in flashlamps, filaments 56 of combustible material having a cross-sectional area of from about 0.25 to 2 square mils may be obtained by this pendant drop extraction method. If the lamps are to be filled with equal length filaments, the distance between notches 58 would be equal.

After manufacture of the filamentary combustible material in this relatively simple and inexpensive manner, the filaments 56 are loaded into the envelope of a flashlamp by any suitable procedure. Thus, a quantity of filaments sufficient to constitute the filling for a single lamp may be gathered together then stuffed into and distributed throughout the envelope by a suitable small rod-shaped tool. Preferably, however, the filaments released from the rotating disk are collected by a funnel-shaped member and pneumatically loaded into the flashlamp envelope in a manner similar to that described in U.S. Pat. Nos. 2,772,703 and 2,862,529, with the pendant drop extraction arrangement of FIG. 3 and a collecting funnel being used in lieu of a shredding machine.

A typical lamp in accordance with the invention may comprise a tubular borosilicate glass envelope 2 having a press seal with Kovar or Rodar inleads as shown in FIG. 1. The outside surface of the envelope is coated with four layers of cellulose acetate 17. Dimensionally the coated envelope has an outside diameter of about 0.280 inch, an inside diameter of 0.200 inch and an internal length of approximately 11/16 of an inch. The inleads 8 and 10 extend inwardly inside the envelope to about ⅛ inch from the end of the envelope at the press seal. The leads support a fine tungsten filament 12 within the lamps, with beads of primer material 14 and 16 about the inner ends of the leads. The primer envelope has an internal volume of about 0.35 cubic centimeters, and the fill of combustible material 18 comprises about 25 milligrams of crumpled four-inch filaments of hafnium formed by release from the periphery of a rotating heat-extracting disk in contact with a pendant drop of hafnium, the disk having notches spaced four inches apart. The cross-sectional area of each filament of hafnium is about one square mil. The lamp envelope is also filled with about 12 atmospheres of oxygen.

In lieu of the four inch filaments 18 or 36, the lamps of FIGS. 1 or 2 may be filled with filaments of a combustible material such as zirconium, hafnium or magnesium, having a length less than about 1.2 times the internal diameter of the tubular envelope to obtain the improved distribution and light output characteristics associated with short shreds. Examples of filament-length and lamp parameters are similar to the shred-length and lamp parameters given in application Ser. No. 179,056 now U.S. Pat. No. 3,895,902. In this instance, the short filaments are of a form as produced by melt extraction with a disk 50 having notches 58 equally spaced apart by a distance less than 1.2 times the internal diameter of the flashlamp envelope being filled. Hence, these short filaments are much less expensive and more easily produced by melt extraction than short shreds produced by feeding slit foil through a shredder.

In lieu of equal length filaments, mixtures of filaments having unequal lengths may be provided in the lamp envelope for further optimization of the burning process, since optimally sized shreds equal to or less than the internal diameter of the bulb, if not densely packed, can fall to the bottom unless supported by longer shreds. Such a lamp fill would be highly impractical using conventional shredding and filling. By using a melt extraction process, however, a controlled distribution of filament lengths is readily provided by using a heat extraction disk 50 having selected unequal distances between the notches 58. In a typical example, the filaments may range in length from approximately equal to the internal diameter of the lamp to about four inches.

Further control over light output characteristics may be provided by filling the lamp with a plurality of filaments having unequal cross-sectional areas arranged in a homogeneous mass. This is to be distinguished from employing fine wire in one portion of the bulb to ignite heavier wire in another portion of the bulb such as shown in U.S. Pat. No. 2,334,155. A homogeneous mass of varying diameter filaments would be highly impractical and unfeasible to obtain by conventional methods. However, by employing melt extraction, a heat-extracting rotating disk having multiple edges of respectively different sizes or geometries in contact with the molten material (which may be provided by a respective multiple of pendant drops) may be used to produce multiple filaments simultaneously. Such a disk 60 is shown in FIG. 5. Thus, several filaments may be produced in parallel with each having a different cross-sectional area as determined by the peripheral geometry of the respective edges 62 from which the filaments are released. In a typical example, the cross-sectional areas of the filaments in a lamp may be in the range of 0.25 to 2 square mils.

The melt extraction process also makes possible the making of fine filaments of a brittle metal or alloy which is otherwise difficult to draw into fine wire; magnesium wire and many rare earth metals are examples. Filaments of brittle intermetallic compounds of hafnium and zirconium become possible, as well as alloys such as aluminum-zirconium and aluminum-hafnium. These capabilities all provide greater flexibility in control of the combustion process.

The enlarged perspective views of FIGS. 6 and 7 illustrate the top and bottom, respectively, of a filament 70 having periodic notches 72 along its length. Such a unique filament configuration may be readily provided from a melt extraction process by employing a rotating disk having periodic discontinuities along its periphery for determining the notches 72 in the released filaments. For example, as shown in FIG. 8, the disk 80 may have a peripheral geometry including a circumferential groove 82 with lateral ridges 84 comprising the periodic discontinuities. In filling the lamp, the filaments will tend to bend and crinkle at the notched areas and thereby provide more of a point contact with the envelope wall. Also, when notched filaments of hafnium or zirconium are burning during ignition, the notches will tend to sever the "snowballing" molten droplets and serve as starting points for new droplets. Accordingly, the notched filaments of FIGS. 6 and 7 can provide the light output advantages described in Bouchard et al U.S. Pat. No. 3,792,957, wherein an increased number of smaller molten droplets are produced during ignition by a coiled or crimped strand configuration. The unique notched filament, however, has the added advantages of being much less expensive and more feasible when produced by a melt extraction process, which is more compatible with high speed production machinery. In a typical example, the filaments 70 may have a length of up to four inches or more and a maximum cross-sectional area of 1 to 2 square mils, and the length of filament 70 between each of the notches 72 may be from about 0.010 to 0.060 inch to assure small droplets. Various combustible materials may be employed for notched filaments, including zirconium, hafnium and magnesium, and in certain applications it may be desirable to space the notches 72 in a nonperiodic fashion.

A variation of the filament configuration of FIGS. 6 and 7 which enables a further increase in number and reduction in size of the molten droplets produced during combustion is illustration in FIG. 9. In this case, the filament 90 has a dumb bell-shaped cross-section and notches 92 along its length. Hence, when such filaments are burning during ignition, they will not only tend to break apart at notches 92, but the dumb bell-section 90*a* will tend to split apart from section 90*b*, as indicated by the arrows in FIG. 9, to thereby produce a greater number of even smaller droplets. Such a filament configuration would be provided by a melt extraction disk having spaced ridges along a V-shaped periphery, rather than a circumferential groove.

Although the invention has been described with respect to specific embodiments, it will be apprecaited that modifications and changes may be made by those skilled in the art without departing from the true spirit and scope of the invention.

What I claim is:

1. A photoflash lamp comprising:

an hermetically sealed, light-transmitting envelope;

a combustion supporting gas in said envelope;

a quantity of combustible material located within said envelope comprising a plurality of filaments which have been formed by release from the periphery of a rotating heat-extracting disk in contact with a melt of said combustible material, each of said filaments having notches along the length thereof; and ignition means attached to said envelope and disposed in operative relationship to said combustible material.

2. A lamp according to claim 1 wherein said combustible material comprises zirconium, hafnium or magnesium.

3. A lamp according to claim 2 wherein said notches are periodic, and the length of filament between each of said periodic notches is from about 0.010 to 0.060 inch.

4. A lamp according to claim 1 wherein each of said filaments of combustible material has a maximum cross-sectional area of about 1 to 2 square mils, and said notches are periodic along the length of each filament and are determined by periodic discontinuities along the periphery of the rotating disk from which said filaments are released.

5. A lamp according to claim 1 wherein each of said filaments has a dumb bell-shaped cross-section.

6. A photoflash lamp comprising:

an hermetically sealed, light-transmitting envelope of substantially tubular shape;

a combustion supporting gas in said envelope;

a quantity of combustible material located within said envelope comprising a mixture of a plurality of filaments having unequal lengths which have been formed by release from the periphery of a rotating heat-extracting disk in contact with a melt of said combustible material, said filaments ranging in length from approximately equal to the internal diameter of said envelope to about four inches and being distributed in a manner whereby the longer filaments provide support for the shorter filaments; and ignition means attached to said envelope and disposed in operative relationship to said combustible material.

* * * * *